US006510902B1

(12) United States Patent
Prokop et al.

(10) Patent No.: US 6,510,902 B1
(45) Date of Patent: Jan. 28, 2003

(54) METHOD AND DEVICE FOR DETERMINING THE OPERATING TIME AND THE OPERATING CONDITION OF A HYDRAULIC PERCUSSION UNIT

(75) Inventors: Heinz-Jürgen Prokop, Ratingen (DE); Marcus Geimer, Essen (DE); Thomas Deimel, Mülheim (DE)

(73) Assignee: Krupp Berco Bautechnik GmbH, Essen (DE)

( * ) Notice: Subject to any disclaimer, the term of this patent is extended or adjusted under 35 U.S.C. 154(b) by 0 days.

(21) Appl. No.: 09/573,874

(22) Filed: May 19, 2000

(30) Foreign Application Priority Data

May 22, 1999 (DE) ..... 199 23 680

(51) Int. Cl.[7] ..... E21B 10/36
(52) U.S. Cl. ..... 173/1; 173/138; 173/2
(58) Field of Search ..... 173/1, 2, 4, 6, 173/11, 138, 182

(56) References Cited

U.S. PATENT DOCUMENTS 4,413,687 A * 11/1983 Eklof ..... 173/207
4,425,835 A * 1/1984 Krasnoff ..... 91/285
4,646,854 A * 3/1987 Arndt et al. ..... 173/134
5,129,466 A * 7/1992 Bartels et al. ..... 173/13
5,174,387 A * 12/1992 Arndt et al. ..... 173/1
5,392,865 A * 2/1995 Piras ..... 173/137
5,890,548 A * 4/1999 Juvonen ..... 173/128

* cited by examiner

*Primary Examiner*—Scott A. Smith
*Assistant Examiner*—Nathaniel Chukwurah
(74) *Attorney, Agent, or Firm*—Venable, Baetjer, Howard and Civiletti, LLP; Robert Kinberg

(57) ABSTRACT

A method and a device for determining the operating time and the operating condition of a hydraulic percussion unit, in particular a hydraulic hammer, having a percussion piston which is guided inside a housing and, under the effect of a controller, alternately performs an operating stroke in an impact direction and a return stroke in a return direction. The method and device obtain information to determine whether the percussion unit requires maintenance operations. Signals are generated during the consecutive, individual operational segments of the percussion unit. The number of signals is proportional to the strokes performed by the percussion piston in one movement direction. The number of the signals is continuously added and is stored as a total number. The current total number of signals can be displayed at least at times for indicating the operating condition of the percussion unit.

34 Claims, 12 Drawing Sheets

METHOD AND DEVICE FOR DETERMINING THE OPERATING TIME AND THE OPERATING CONDITION OF A HYDRAULIC PERCUSSION UNIT

CROSS REFERENCE TO RELATED APPLICATIONS

This application claims the right of priority of German patent application No. 199 23 680.1, filed May 22, 1999, the disclosure of which is incorporated herein by reference.

BACKGROUND OF THE INVENTION

The invention relates to a method for determining the operating time and the operating condition of a hydraulic percussion unit such as a hydraulic hammer, comprising a percussion piston which moves inside a housing and alternately performs an operating stroke in a hammering direction and a return stroke. The invention furthermore relates to a device for practicing the method.

Hydraulic percussion tools, in particular hydraulic hammers, are used for crushing material (e.g. for crushing rock or concrete). During the crushing process, the kinetic energy of a percussion piston when it strikes a tool is introduced via the tool and the tool tip into the material to be processed and the kinetic energy is converted into destructive actions. Depending on the hardness of the material to be processed, only a portion of the kinetic energy is converted to destructive action. The remaining, non-converted energy share is reflected via the tool back into the percussion piston. With soft material, on the other hand, the percussion energy is converted completely into destructive actions.

Hydraulic percussion units of the aforementioned type, disclosed, for example, in German Patent No. 34 43 542, (to which corresponds U.S. Pat. No. 4,646,854) represent highly stressed devices that require extensive monitoring and corresponding care and maintenance in consideration of their economy and operational safety, particularly in view of the otherwise heavy-duty operating conditions. Of essential importance in this connection is the operating time of the hydraulic percussion unit, that is to say the information on the total time span during which the hydraulic percussion unit has been actively used.

SUMMARY OF THE INVENTION

It is an object of the invention to provide a method and apparatus for determining the operating time and the operating condition of a hydraulic percussion unit, so as to be recognizable in particular to an operator. The personnel in charge thus can decide whether the unit is already in need of maintenance operations or whether the respective percussion unit can continue to be used.

This object and others to become apparent as the application progresses, are accomplished by the invention, which makes use of the realization that the actual total number of hammer strikes carried out by the percussion unit represents a relevant variable for determining the active operating time. Information on the operating condition of the respective percussion unit can be inferred from the total number of hammer strikes by comparison with corresponding specified values. The information relating to the operating condition in the simplest case can be indicated by the completion of a maintenance-free operating interval, which thus indicates a need for maintenance.

A method according to the invention for determining the operating time and the operating condition of a hydraulic percussion unit provides the feature that a number of signals are generated during the individual, chronologically following operating periods of the percussion unit which are proportional to the strokes carried out by the percussion piston in one movement direction. The number of signals is continuously added up and is stored as a total number, and the current total number for the signals is shown at least at times in the form of a display indicating the operating condition. The above-addressed display can be of an optical and/or acoustic nature within the framework of the invention. For example, by generating a continuous acoustic warning signal, it is possible to indicate that an operating condition requiring maintenance exists once a specified total signal number is reached.

The total signal number may be continuously added up—independently of a possible display concerning the operating condition—and stored, so that it can also be determined to what degree a predetermined maintenance interval has been exceeded by continuing to operate the hydraulic percussion unit.

The type of signals and the manner in which they are generated is optional within the framework of the invention, as long as it is ensured that their number provides information on the number of strokes carried out by the percussion piston in one movement direction. The signals may be generated with the aid of a sensor, which detects physical processes or related changes in condition occurring as a result of the percussion piston movements.

The signals are preferably generated in dependence on at least one of the following physical processes: pressure, motion, sound level, temperature, flow and vibration. However, the invention can also be embodied further in that the actual total number of signals, detected in the previously mentioned manner, is provided with a correction factor in dependence on at least one other influencing variable, e.g. the measured outside temperature. Thus, the display indicating the end of a maintenance interval is triggered at an earlier point in time if a specified outside temperature is not reached.

With a particularly simple embodiment of the method according to the invention, pressure fluctuations or flow processes are detected, which occur in one of the supply lines for the percussion unit, namely the pressure line for the fluid entering the percussion unit and the return-flow line for the return flow of the exiting fluid. In this embodiment, pressure fluctuations or changes in the flow rate—which occur periodically in dependence on the percussion piston strokes—can be converted to signals by means of a pressure monitor or by means of a flow rate meter. These embodiments further have the advantage that they can be installed at a later date without special expenditure and independently of the remaining structural design of the hydraulic percussion unit.

However, the method can also be realized in that the signals that are proportional to the percussion piston strokes are generated on the basis of a sound measurement or by detecting vibrations. For the first type of measurement, a sound transmitter such as a microphone can be used and, if necessary, followed by a suitable, downstream-connected filter. For the second case, the vibrations triggered by the percussion piston movements can be detected by means of a vibration transmitter. This vibration transmitter comprises a vibration sensor that vibrates in the manner of a seismic mass and which cooperates with a plunger coil. The vibration sensor is stimulated to move relative to the plunger coil by the vibrations emanating from the percussion unit. As a result, signals corresponding to the vibrations are generated inductively.

Alternatively, the method can also be realized by detecting with a motion sensor the displacement of a percussion unit component that moves in one movement direction as a result of the percussion strokes. In the simplest case, the movements of the percussion piston itself can be converted into respective signals by an induction coil surrounding the percussion piston without contacting the same. The induction coil is preferably arranged at that side of the percussion piston which faces away from the percussion piston tip.

Within the scope of the invention, the method can also be realized in that the stress exerted on one component of the percussion unit—which stress changes periodically with the hammering actions carried out by the percussion piston—is detected by means of a force sensor or a voltage sensor. Sensors designed as strain gauges or as piezo elements can be used for this purpose, to convert the occurring stress conditions into signals. In the simplest case, the respective sensors are installed on the percussion unit housing in such a way that they are also deformed by the stress caused by the percussion piston strokes.

If the hydraulic percussion unit is provided with a gas cushion that supports the percussion piston, suitable signals can be generated by detecting the temperature or pressure of the gas cushion by means of a temperature sensor or a pressure monitor. Since the gas cushion is normally arranged on the side of the percussion unit that is opposite the percussion piston tip, these sensors (temperature sensor, pressure monitor) are located relatively far from the direct operating range of the percussion unit.

The method is preferably improved further in consideration of the aspects of operational safety and economy, by providing that once a predetermined total signal number is reached, at least one maintenance display is generated, which indicates at least that the percussion unit requires maintenance. In particular, this can involve a warning lamp—for example, of red color—that lights up and indicates the end of a maintenance-free service interval.

It is also possible to generate in timely succession several early warning indicators depending on the current total signal number. These indicators can show that partial segments of the maintenance interval defined by a predetermined upper limit for the total signal number have been reached.

The above early warning indicators can include a green warning light that lights up initially and, at a later time, a yellow warning light that lights up prior to reaching an upper limit for the predetermined total signal number. As a result, it is possible to detect in stages the actual operating condition of the percussion unit.

Additional advantageous embodiments of the method utilize wireless transmission. Among others, these embodiments make it possible to provide the essential information at a location that is spatially removed from the percussion unit.

Batteries or accumulators can be used to generate the electrical energy required to make the signals available, including obtaining, adding up and storing the signals. For such purpose the energy units should be provided with a charge indicator to avoid malfunctions. The electrical energy for providing the signals may be generated by the fluid that drives the percussion piston. In particular, the unit provided for supplying electrical energy can comprise an auxiliary hydraulic motor and a generator driven by the motor, as well as a downstream-connected electric storage unit.

Alternatively, the electrical energy for providing the signals can also be generated by a generator, which becomes effective as a result of the movements triggered by the percussion piston strokes and which has a downstream-connected electric storage unit. The basic design of such an independently operating generator can correspond in particular to the previously mentioned vibration sensor.

The objects of the invention are furthermore solved by a device which generates a number of signals proportioned to the number of strokes performed by the percussion piston. The device can be provided with a sensor that converts into signals physical processes occurring as a result of the percussion piston movements.

DETAILED DESCRIPTION OF THE PREFERRED EMBODIMENTS

Figure 1:
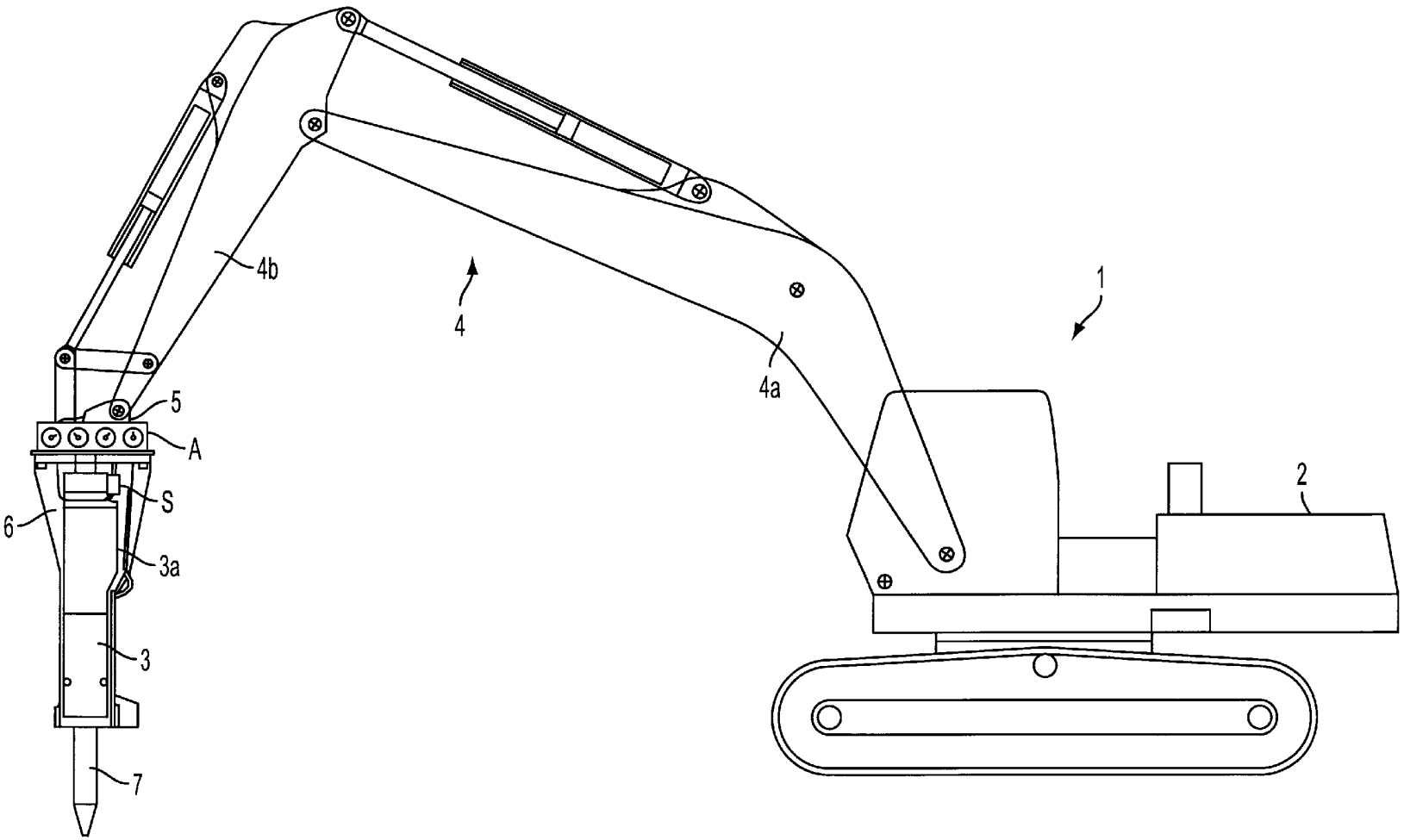
FIG. 1 is a schematic side elevation of a base unit designed as a hydraulic excavator, to which a hydraulic hammer is attached.
Figure 3B:
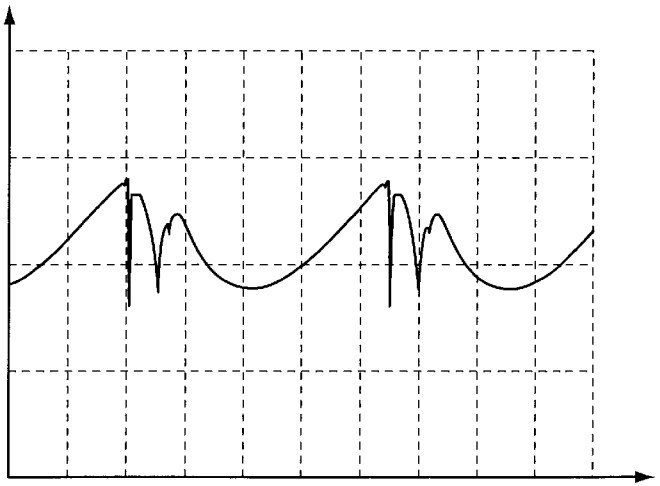
FIG. 3*b* is a time diagram showing the signal sequence generated by the pressure monitor of FIG. 3*a*.
Figure 3A:
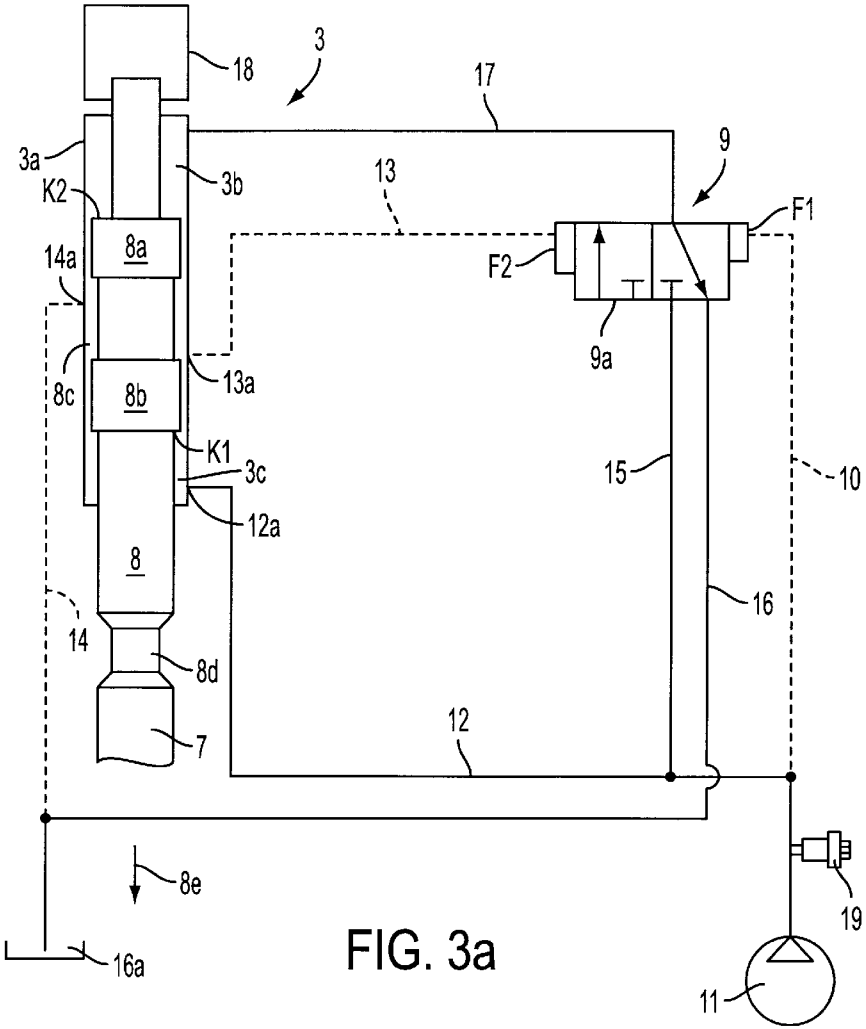
FIG. 3*a* is a switching diagram of the switching unit including a pressure monitor.

The hydraulic excavator 1 shown in FIG. 1 comprises a supply unit 2 including a diesel engine (not shown) and a hydraulic pump operated by the engine (see also FIG. 3*a*). The hydraulic pump is connected in a known manner to a hydraulic hammer 3, which in turn is attached adjustably to the boom 4 of the hydraulic excavator with two cantilever arms 4*a*, 4*b*. The cantilever arm 4*b* in turn carries a pivotable connection bracket 5 with an attached support element 6, designed as base housing or support arm. The hydraulic hammer 3 is supported on the support element 6 by way of its housing 3*a*.

Under the effect of the fluid supplied by the supply unit 2, the hydraulic hammer 3 acts upon a tool designed as chisel 7, wherein the movement energy emanating from the hydraulic hammer is converted to impact energy.

A display element A is arranged above the support element 6, which displays among others information on the operating time and the operating condition of the hydraulic hammer 3. The hydraulic hammer comprises a sensor S for generating signals, which are continuously added up, are stored as a total number and are displayed on the display element A.

Figure 2:
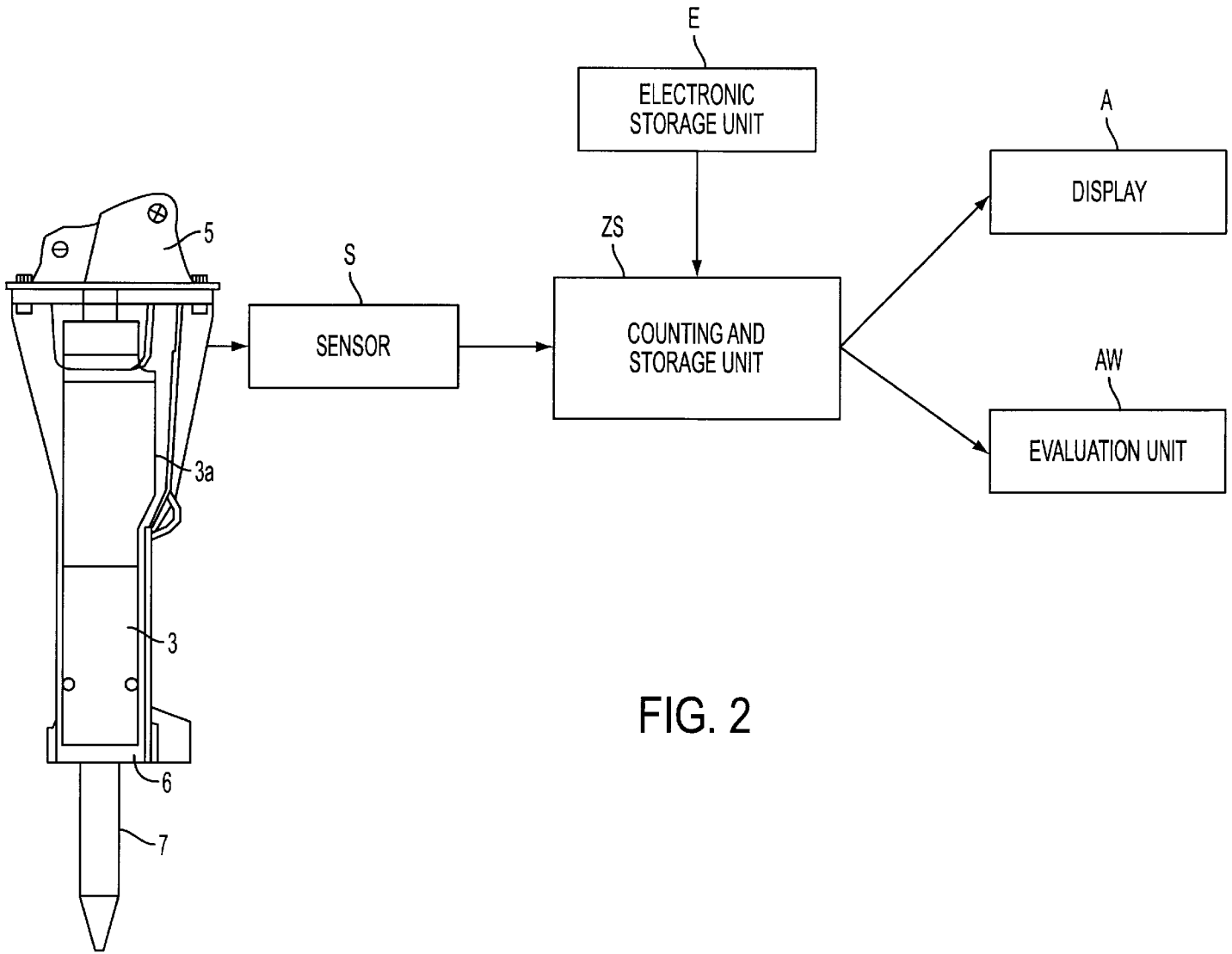
FIG. 2 is a basic functional schematic drawing of an apparatus according to the invention.

FIG. 2 schematically shows additional details of the operational sequence and cooperation between the processes, which eventually provide information on the operating time and the operating condition of the hydraulic hammer 3. The sensor S subsequently converts the processes occurring during the operation of the hydraulic hammer 3 into signals. The total number of signals is added up continuously in a counting and storage unit ZS and is stored as total number, wherein the current total number for the signals is displayed on the display device A, which indicates the operating condition of the hydraulic hammer. The electrical energy required for providing the signals and the information derived therefrom is made available by an electric storage unit E. If necessary, the information obtained by means of the counting and storage element ZS can be transmitted with wireless transmission to an evaluation unit AW.

The sensor S is arranged and designed such that the signals are generated during the individual, chronologically following operating segments of the hydraulic hammer 3. The signal number is proportional to the number of strokes executed by the percussion piston of the hydraulic hammer in one movement direction. Thus, the sensor detects processes or conditions as well as changes in the conditions that are triggered by the percussion piston movements and displays these processes, conditions or changes in the conditions in the form of a signal. By adding up the individual, chronologically following signals, it is possible to obtain information on the active operating time. From this, it is possible to derive information on the operating condition of hydraulic hammer 3 as it relates to predetermined maintenance intervals. This information can be displayed by way of display device A and, if necessary, can be transmitted with wireless transmission to the evaluation unit AW. The display device A can be configured such that once a predetermined total number of signals is reached, at least one maintenance indicator is generated, which shows that the end of a maintenance-free operational interval has been reached. In addition, the display device can also be designed such that several early warning indications, which follow each other chronologically, are generated in dependence on the respectively current total signal number for gradually indicating the approach of the end of a maintenance-free interval.

As shown in FIG. 3*a*, the hydraulic hammer 3 additionally comprises the previously mentioned housing 3*a* in addition to the lines as well as drive elements and control elements, which are yet to be described. Inside of the housing 3*a* a percussion piston 8 moves back and forth in a longitudinal direction. The percussion piston 8 comprises two piston collars 8*a* and 8*b* inside the cylinder chamber of housing 3*a*, which are separated by a circumferential groove 8*c*.

The outward-facing piston surfaces K1 and K2 of the piston collar 8*b* or 8*a* along with the housing 3*a* define a rear cylinder chamber segment 3*b* and a front cylinder-chamber segment 3*c*. The piston surface K1 is smaller than the piston surface K2.

Outside of the housing 3*a*, the percussion piston 8 changes over to a piston tip 8*d* that adjoins the chisel 7. An arrow 8*e* indicates the direction of movement of the percussion piston 8 in the direction of the operating stroke.

FIG. 3*a* shows the hydraulic hammer 3 in a state immediately following the impact of the percussion piston 8 on the chisel 7.

The control for switching the movement of percussion piston 8 includes a control plunger 9*a*, which moves inside a control valve 9. The smaller plunger surface F1 is constantly charged with the operating pressure (system pressure) by way of a resetting line 10. The operating pressure is generated by a hydraulic pump 11 (which itself is a component of the supply unit 2). The smaller piston surface K1 is constantly charged with the operating pressure by way of a pressure line 12, which is connected to the resetting line 10. Relative to the housing 3*a*, the mouth 12*a* of the pressure line is arranged such that it is always positioned outside of the piston collar 8*b* and thus inside the front cylinder chamber segment 3*c*.

The larger plunger surface F2 is connected via a reversing line 13 to the cylinder chamber of housing 3*a* such that for the condition illustrated herein, its mouth 13*a* is connected by way of the circumferential groove 8*c* to a non-pressurized return-flow line 14. The mouth 13*a* and the mouth 14*a* of the return-flow line 11, thus are located opposite each other at a distance, as seen in the longitudinal direction of the percussion piston 8, which distance is less than the axial length of the circumferential groove 8*c*.

The control valve 9 is connected on the one side via a control line 15 to the pressure line 12 and, on the other side, via a discharge line 16, including the sump 16*a*, to the return-flow line 14. The control valve 9 furthermore is connected via an alternating pressure line 17 to the rear cylinder chamber segment 3*b*, by way of which the larger piston surface K2 can be charged with operating pressure, if necessary.

The control valve 9 can assure two valve positions, namely the depicted (right) return-stroke position, in which the larger piston surface K2 is relieved of pressure via the alternating pressure line 17 and the discharge line 16 and the (left) operating stroke position, in which the rear cylinder chamber segment 3*b* is charged with operating pressure by way of the pressure line 12, the control line 15 that is connected to the pressure line, and the alternating pressure line 17. As a result, the percussion piston 8 performs an operating stroke in the direction of arrow 8*e*, opposing the resetting force emanating from the smaller piston surface K1.

A chamber 18 which is arranged above the rear cylinder chamber segment 3*b,* accommodates a gas cushion under pressure. The percussion piston 8 is supported on the gas cushion, on the side facing away from the piston tip 8*d.*

In order to generate the previously noted signals, the pressure line 12 is provided with a sensing device in the form of a pressure monitor 19, preferably near its entrance into the housing 3*a* (see also FIG. 1). The monitor 19 detects pressure fluctuations inside the pressure line 12 which are triggered by the percussion piston movements, and converts the pressure fluctuations into signals. The chronological course of the signals is indicated in FIG. 3*b.* As previously mentioned, these signals, which are proportional in number to the strokes performed by the percussion piston in one movement direction, can be used to obtain and display information concerning the current operating time and the operating condition of the hydraulic hammer 3.

Figure 4B:
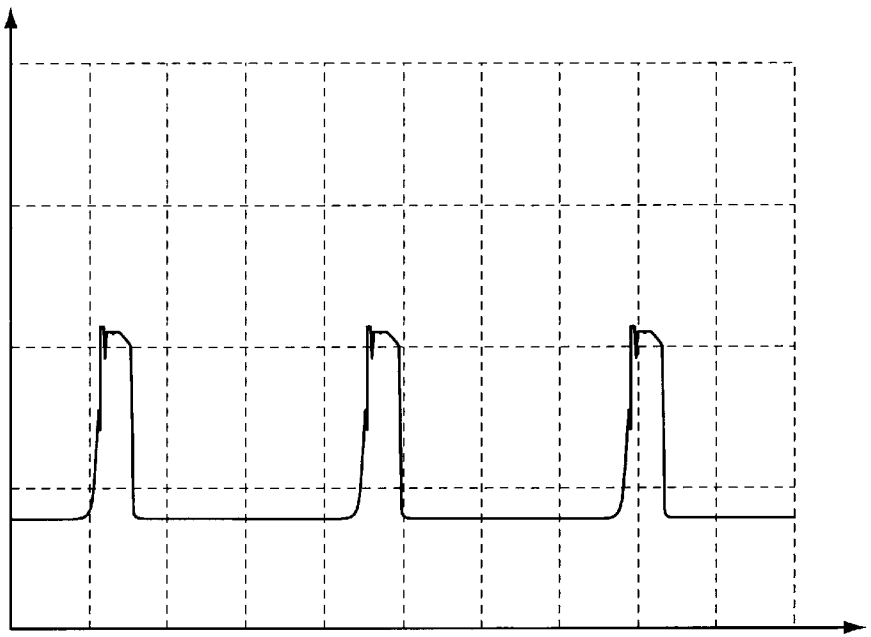
FIG. 4*b* is a time diagram showing the signal sequence generated by the pressure monitor of FIG. 4*a*.
Figure 4A:
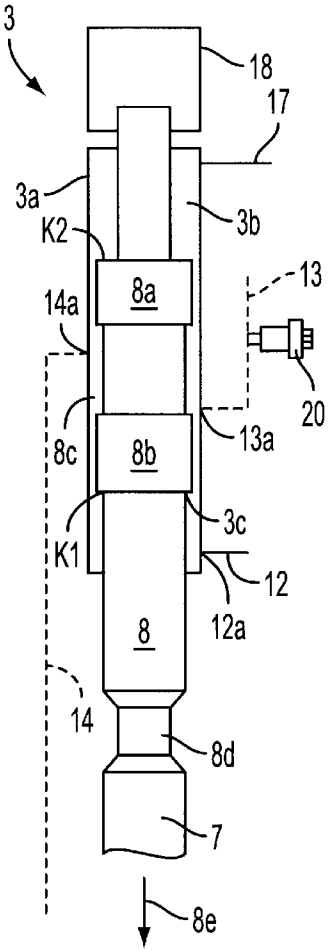
FIG. 4*a* is a partial diagram corresponding to FIG. 3*a* including a pressure monitor in the reversing line.

Turning to FIG. 4*a,* a pressure monitor 20 is positioned in the reversing line 13 and is thus integrated into the control for the hydraulic hammer 3. The signals generated by the pressure monitor 20, as indicated in FIG. 4*b,* are formed in dependence on the position of the piston collar 8*b,* relative to the mouth 13*a* of the reversing line 13. As long as the mouth 13*a* is connected, as shown, by the circumferential groove 8*c* to the return-flow line 14, the lower pressure level shown in FIG. 4*b* is present in the reversing line 13. This pressure level changes only after the piston collar 8*b* has covered the mouth 13*a* and a connection between the pressure line 12 and the reversing line 13 is finally established via the front cylinder chamber segment 3*c.* The pressure monitor 20 is thus in a position to generate signals in dependence on the percussion piston strokes and proportional to the number of these strokes. The signals can subsequently be added and evaluated.

Figure 5B:
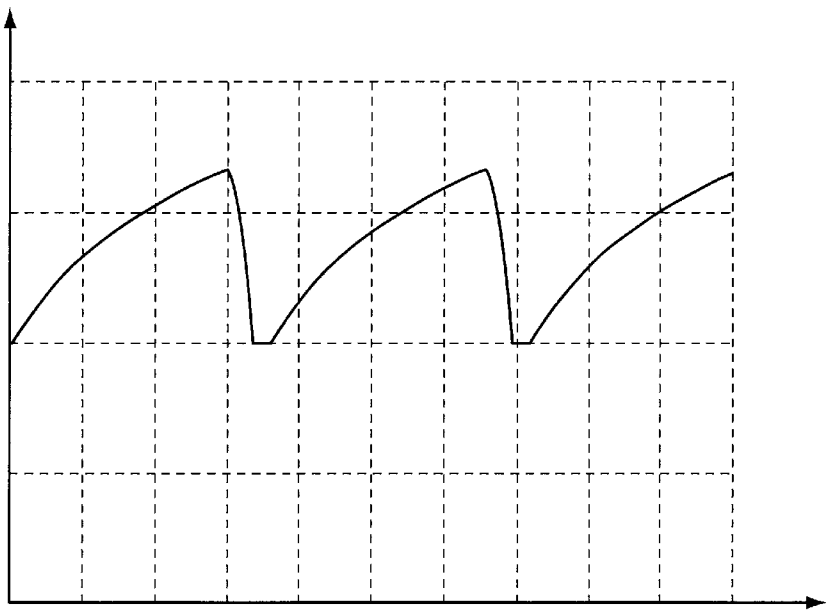
FIG. 5*b* is a time diagram showing the signal sequence generated by the pressure monitor of FIG. 5*a*.
Figure 5A:
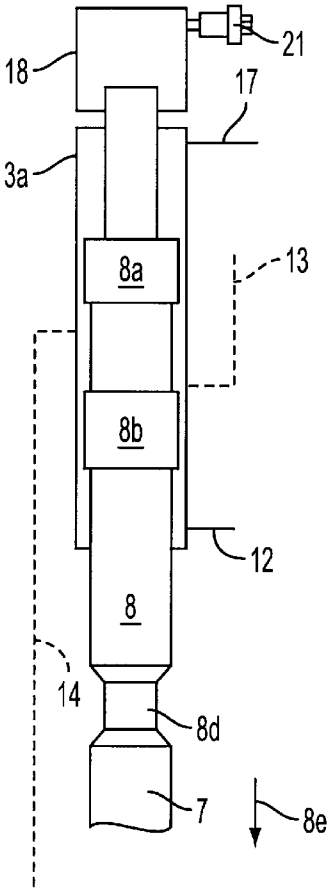
FIG. 5*a* is a partial diagram corresponding to FIG. 3*a* including a pressure monitor coupled to a gas cushion.
Figure 6B:
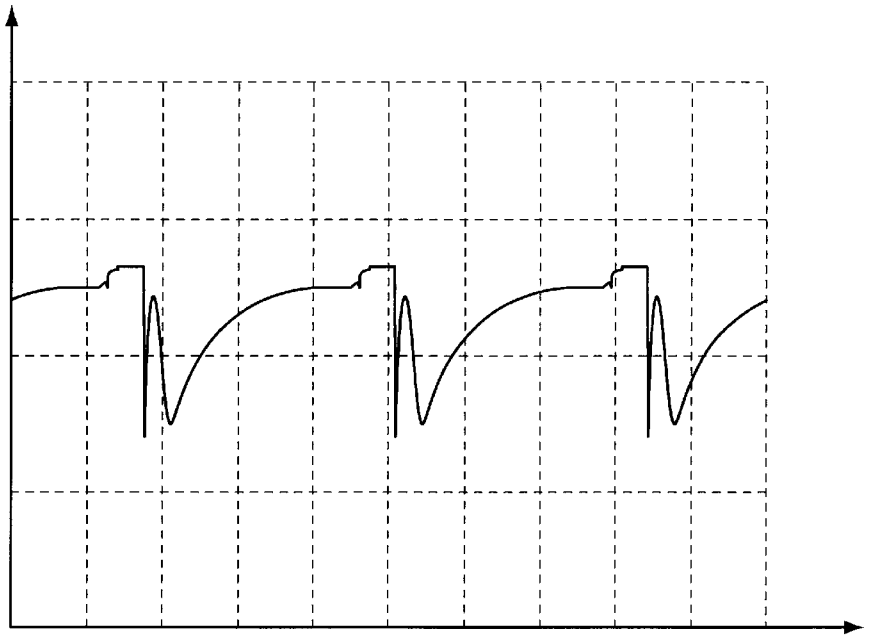
FIG. 6*b* is a time diagram showing the signal sequence generated by the temperature sensor of FIG. 6*a*.
Figure 6A:
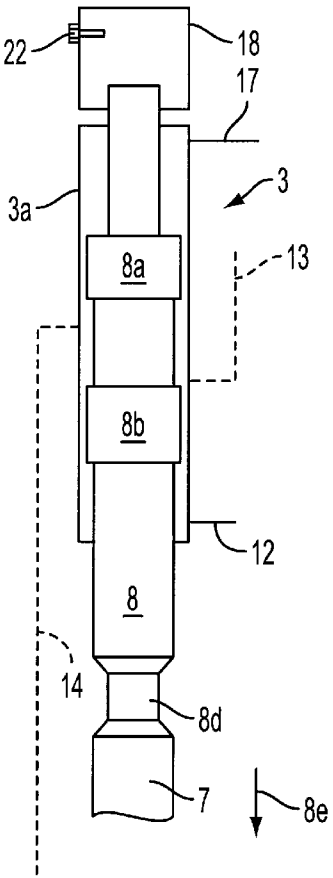
FIG. 6*a* is a partial diagram corresponding to FIG. 3*a* including a temperature sensor coupled to the gas cushion.

In case a gas cushion supporting the percussion piston 8 is present in the chamber 18, according to the invention the condition of the gas cushion is detected by means of a pressure monitor 21 (see FIG. 5*a*) or by means of a temperature sensing device 22 (see FIG. 6*a*) and is subsequently converted to signals (see FIGS. 5*b* and 6*b*). The movement of percussion piston 8 in the direction of the operating stroke (arrow 8*e*) results in a dropping of the pressure and thus also the temperature of the gas cushion. In contrast, the percussion piston movement during the return stroke leads to an increase in the pressure and the temperature. Accordingly, signals can also be generated by means of sensing devices 21 and 22, and the number of the signals depends on the movement of the percussion piston.

Figure 7B:
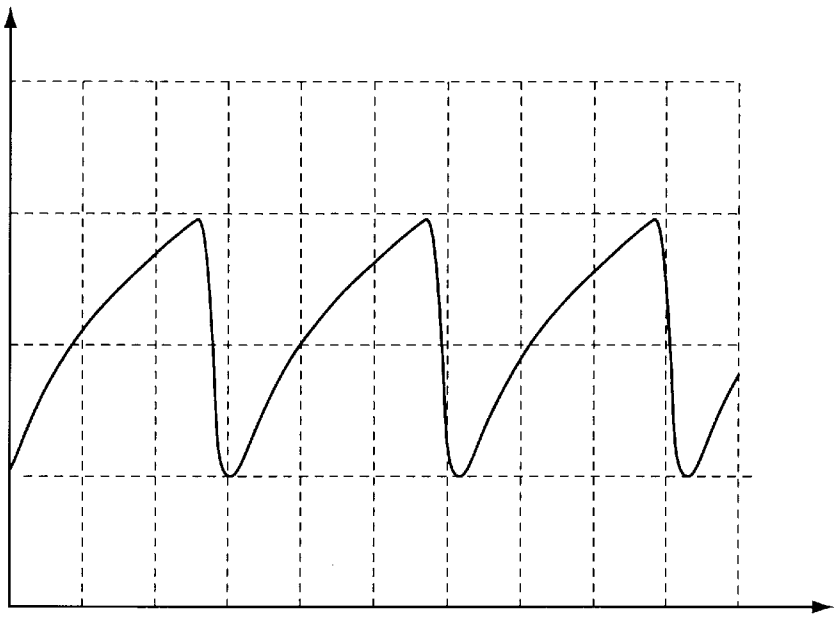
FIG. 7*b* is a time diagram showing the signal sequence generated by the motion sensor of FIG. 7*a*.
Figure 7A:
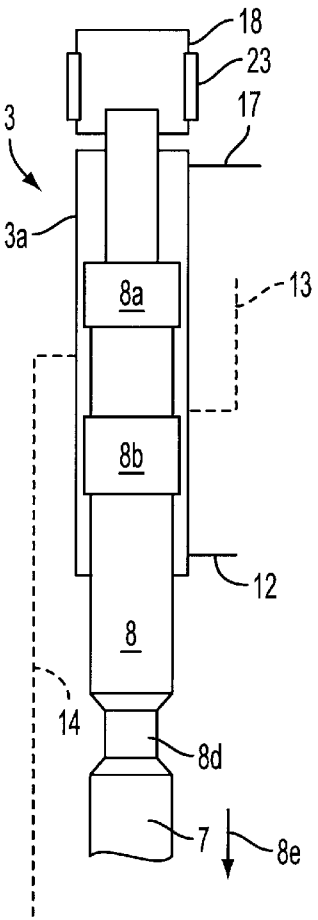
FIG. 7*a* is a partial diagram corresponding to FIG. 3*a* including a motion sensor that cooperates with the percussion piston.

FIGS. 7*a* and 7*b* relate to an embodiment of the invention, in which a motion sensor is used to detect the displacement of a component of hydraulic hammer 3, moving in one movement direction owing to the percussion piston strokes. This motion sensor is designed as an inductively operating plunger coil 23, which is a component of chamber 18 and partially encloses the percussion piston 8, depending on its position inside the housing 3*a.* The relative movements of the percussion piston 8 with respect to the plunger coil 23 trigger chronologically changing induction processes. The chronological course of these processes is shown in FIG. 7*b.* According to the invention, these induction processes can be used to obtain information on the actual operating time of the hydraulic hammer 3 and its operating condition.

Figure 8B:
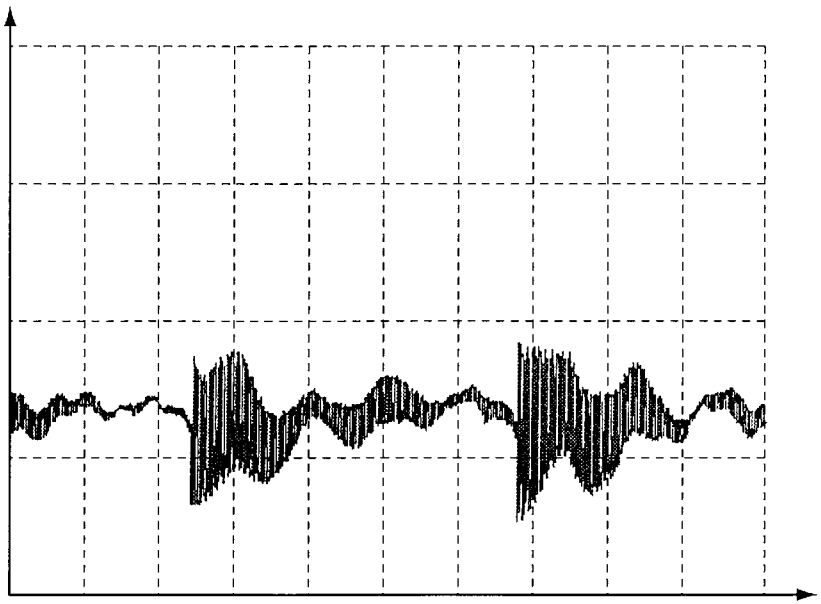
FIG. 8*b* is a time diagram showing the signal sequence generated by the vibration sensor of FIG. 8*a*.
Figure 8A:
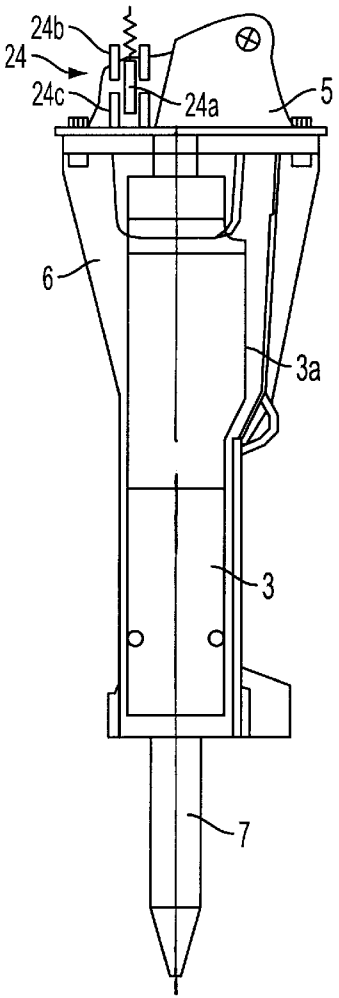
FIG. 8*a* is a schematic representation of a hydraulic hammer including a vibration sensor.

Further, according to the invention, movements caused by the percussion piston strokes may be detected by means of a vibration sensor and are converted into corresponding signals. In the embodiment according to FIGS. 8*a* and 8*b,* the vibration sensor 24 comprises as essential component a spring-supported vibrating member 24*a,* which can carry out reciprocating movements between two plunger coils 24*b* and 24*c* as a seismic mass. These movements lead to induction processes with a chronological course as shown in FIG. 8*b.* The reciprocating movements of the vibrating member 24*a,* relative to the plunger coils 24*b* and 24*c,* are caused by the vibrations that occur as a result of the percussion piston strokes. The vibration sensor 24 for the exemplary embodiment shown herein is mounted as a unit on the connection bracket 5 above the hydraulic hammer 3. It is to be understood that a different type of arrangement can also be used within the framework of the invention. In particular, the vibration sensor 24 inside the support element 6 can be attached directly to the housing 3*a* of the hydraulic hammer or the support element 6 itself.

Figure 9B:
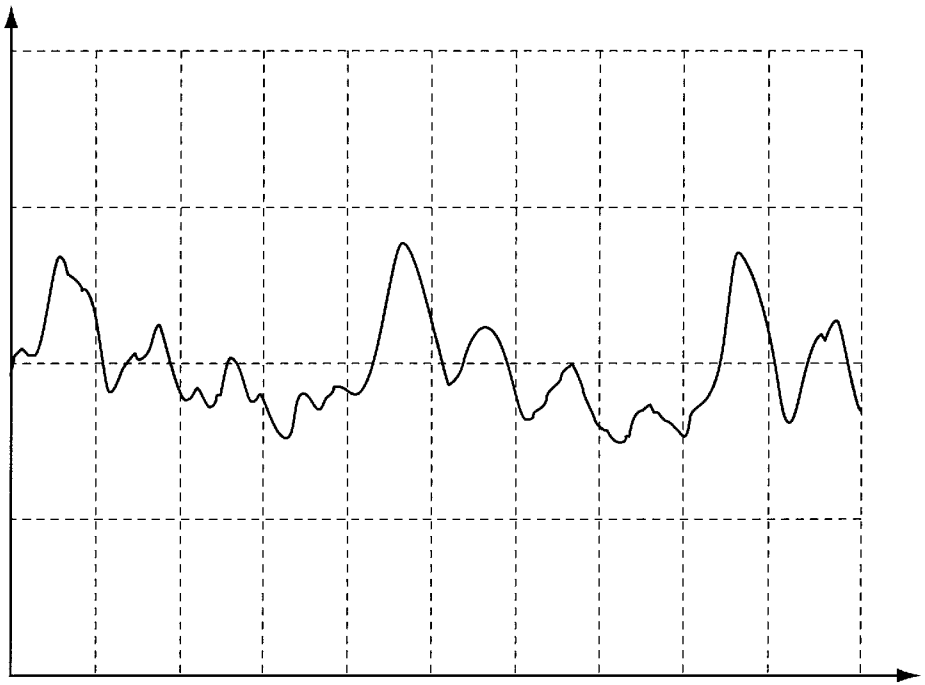
FIG. 9*b* is a time diagram showing the signal sequence generated by the strain gauge of FIG. 9*a*.
Figure 9A:
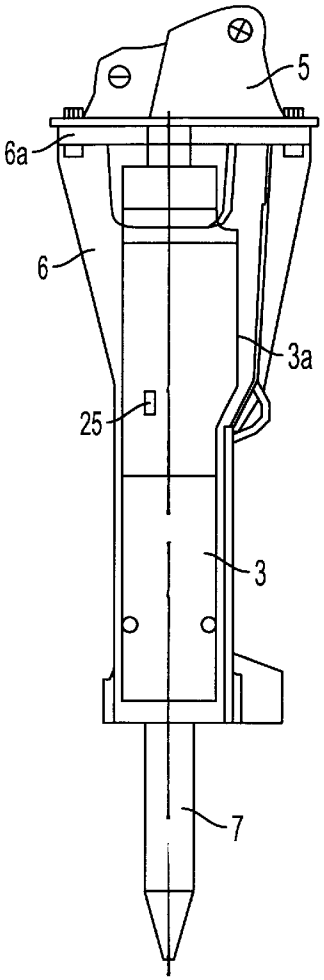
FIG. 9*a* is a schematic representation of a hydraulic hammer including a strain gauge.

FIGS. 9*a* and 9*b* show an embodiment of the invention where the stress exerted on a component of the hydraulic hammer—which changes periodically with the impacts carried out by the percussion piston—is detected by means of a voltage sensor and is converted to signals. For this purpose a strain gauge 25 is attached to the housing 3*a* of the hydraulic hammer 3. In dependence on the stress exerted on the housing 3*a,* the strain gauge is periodically subjected to elastic deformations, from which signals shown in FIG. 9*b* can be obtained. Deviating from the embodiment shown, the stress sensor can also be composed of several interconnected strain gauges. In place of the at least one strain gauge, a force sensor can be used which comprises at least one piezo element as sensing device. For example, the force sensor can be arranged such that the associated piezo elements are attached without play above the housing 3*a,* between the housing 3*a* and the flange 6*a* for fastening the support element 6.

An additional option for generating suitable signals consists in detecting different noise levels in dependence on the percussion piston strokes. This noise level respectively reaches briefly a peak value if the percussion piston with chisel 7 impacts on the material to be processed.

Figure 10B:
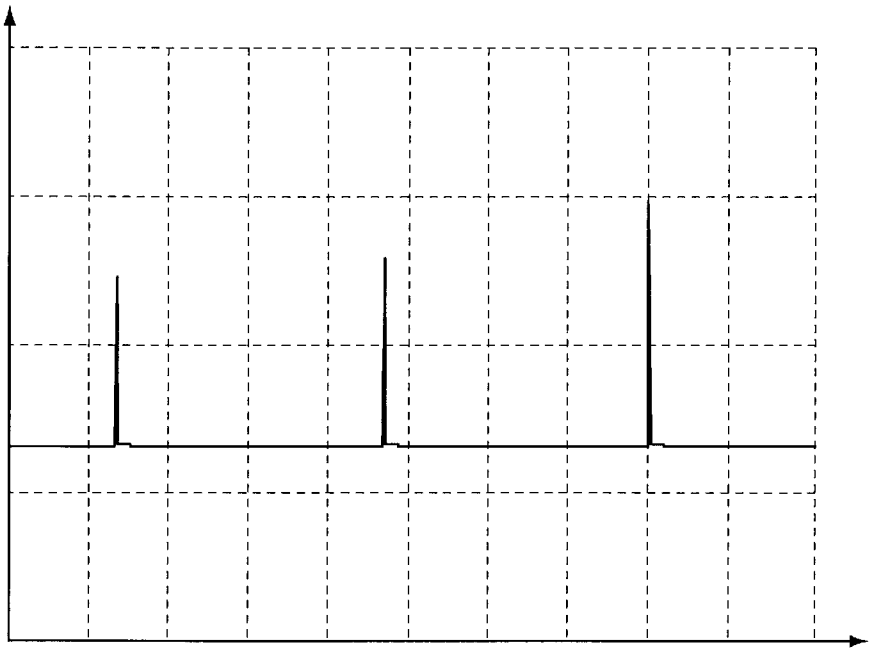
FIG. 10*b* is a time diagram showing the signal sequence generated by sound level sensor of FIG. 10*a*.
Figure 10A:
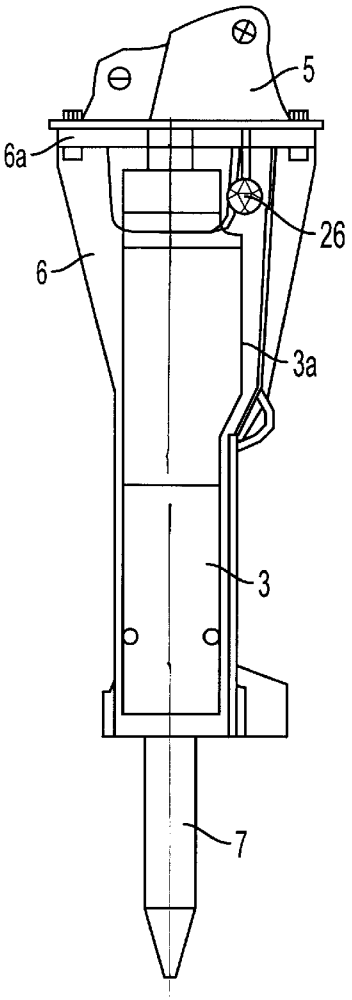
FIG. 10*a* is a schematic representation of a hydraulic hammer including a sound level sensor formed by a microphone.

In the exemplary embodiment according to FIGS. 10*a* and 10*b,* the sound level sensor is a microphone 26, which is arranged below the flange 6*a,* between the supporting element 6 and the housing 3*a* of the hydraulic hammer 3. With a suitable design of microphone 26 or the downstream installation of a filter, it can be ensured that the pulse-type signals shown in FIG. 10*b* are generated only during the impact with the material to be processed. The number of the signals corresponds to the number of piston impacts.

Figure 11B:
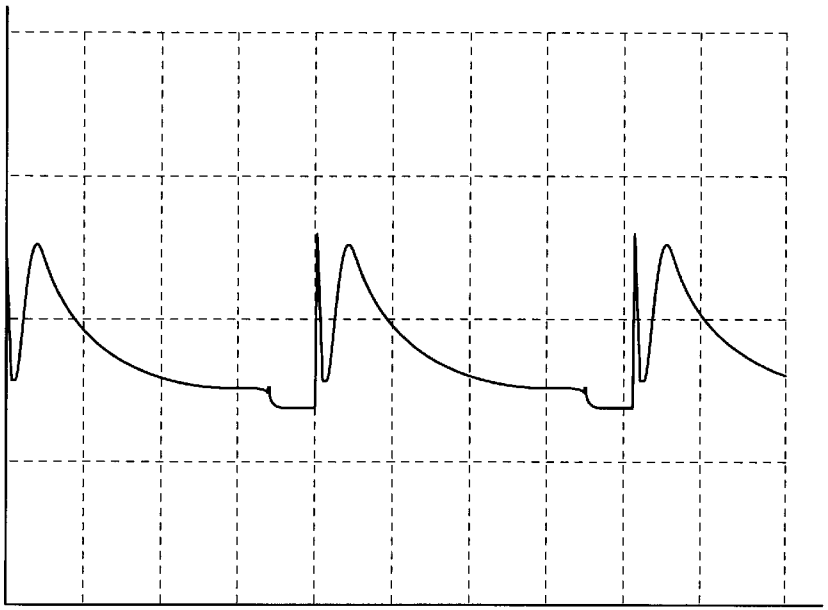
FIG. 11*b* is a time diagram showing the signal sequence generated by the acceleration sensor of FIG. 11*a*.
Figure 11A:
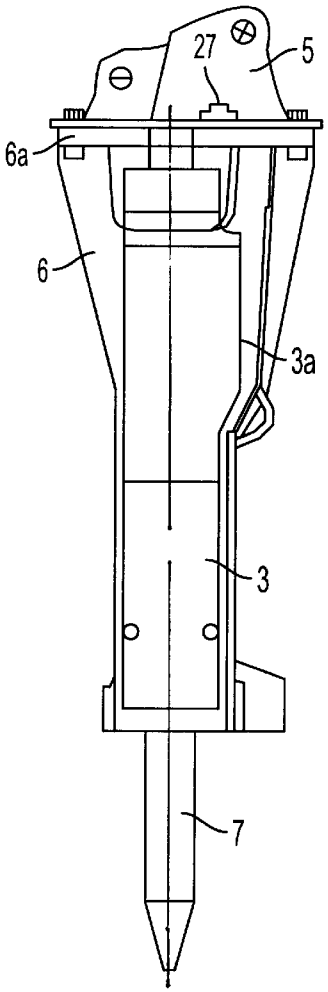
FIG. 11*a* is a schematic representation of a hydraulic hammer including an acceleration sensor.

In the embodiment according to FIGS. 11*a* and 11*b,* an acceleration sensor 27 is provided for generating the signals of interest herein. The acceleration sensor is supported above the flange 6*a* on the connection bracket 5. However, within the scope of the invention it can also be installed at another suitable location, in particular on the flange 6*a,* the support element 6 itself or the housing 3*a.* The movements caused by the percussion piston strokes can be converted by means of the acceleration sensor 27 into signals having a periodically recurrent course.

Figures 12, 13:
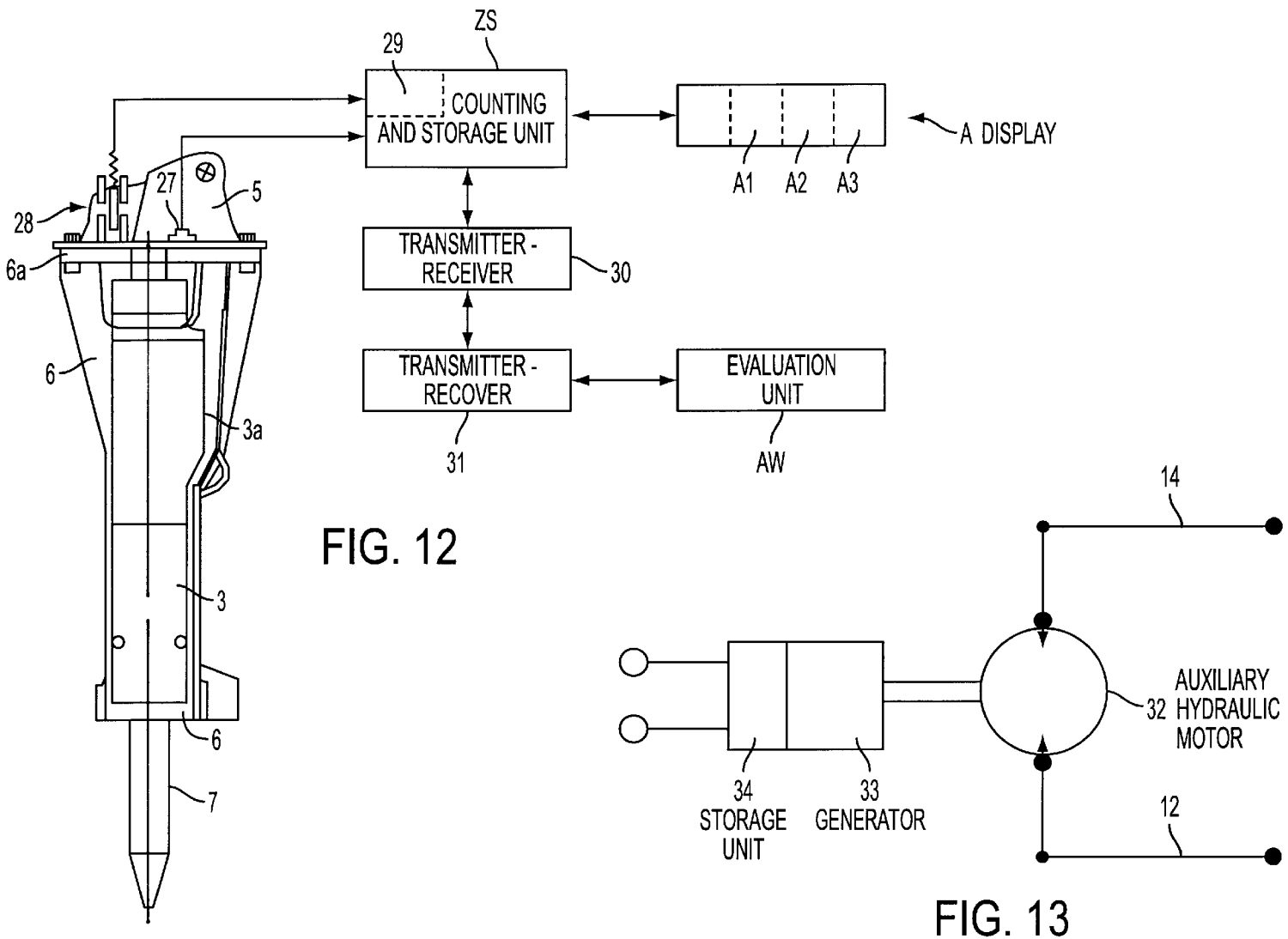
FIG. 12 is a schematic representation of a hydraulic hammer including an acceleration sensor and a generator for generating the electric energy, as well as additional devices.
FIG. 13 is a schematic drawing of the configuration for an electric energy supply using an auxiliary hydraulic motor.

In the embodiment according to FIG. 12, the signals for determining the operating time and the further information derived therefrom are obtained by means of the acceleration sensor 27, as explained with the aid of FIGS. 11*a* and 11*b.* A generator 28, coupled to the unit consisting of hydraulic hammer 3 and support element 6, generates the electric energy required for providing the signals and other information. The design of the generator 28 corresponds to that of the vibration sensor 24, previously described with the aid of FIG. 8*a*. The vibrations occurring as a result of the operation are converted by means of generator 28 into electric energy, which is taken up and stored by an electric storage unit 29, a component of the counting and storage unit ZS. The signals generated by the acceleration sensor 27 are added up in the counting and storage unit ZS and stored as total signal number.

A display device A which is connected to the unit ZS, can display the current total signal number and, if necessary, can provide further information concerning the operating condition of the hydraulic hammer 3. The additional information involves the generating of several early warning displays A1 and A2 successively over time, in dependence on the respectively current total signal number. Once a predetermined total signal number is reached, a maintenance indicator A3 appears, which indicates the end of a defined maintenance interval.

A transmitter/receiver unit 30, connected to the counting and storage element ZS, can be used for the wireless transmission of the respective information to a transmitter/receiver unit 31. This unit in turn is connected to an evaluation unit AW (in particular a computer). The evaluation unit AW not only permits the evaluation of the stored information, but also functions to influence stored information by resetting to a desired resetting value. The resetting is made possible in that the commands issued by the evaluation unit AW are also transmitted wirelessly to the unit ZS as a result of the cooperation between units 31 and 30.

Departing from the previously described embodiment, the electric energy for providing the signals and the information derived therefrom can be generated by means of an auxiliary hydraulic motor 32, as can be seen in FIG. 13, which is connected on the intake side with the pressure line 12 and on the outlet side to the return-flow line 14 (see also FIG. 3*a*). The auxiliary motor 32 drives a generator 33 applying electric energy to an electric storage unit 34. This arrangement thus makes it possible to generate the electric energy by means of the fluid which also drives the percussion piston. For this purpose the electric storage unit 34 can be connected, for example, as an independent element, to the unit ZS or, as shown in FIG. 12, can be integrated into the unit ZS as a component 29.

It will be understood that the above description of the present invention is susceptible to various modifications, changes and adaptations, and the same are intended to be comprehended within the meaning and range of equivalents of the appended claims.

What is claimed is:

1. A method for determining the operating period and the operating condition of a hydraulic percussion unit having a percussion piston guided inside a housing and controlled by a control means to alternately perform an operating stroke in a first movement direction and a return stroke in a second movement direction, the method comprising the steps of:

generating a number of signals proportional to the number of percussion piston strokes performed in one of the movement directions during consecutive operation segments of the percussion unit;

continuously adding the number of generated signals;

storing the total number of added signals; and displaying at least at times an indication for the operating condition of the percussion unit based on the current total number of added signals.

2. A method according to claim 1, wherein the signals are generated in dependence on at least one of pressure, motion, sound level, temperature, flow amount, stress and vibration.

3. A method according to claim 1, wherein the percussion unit has at least one supply line and the generating step includes a step of detecting at least one of pressure fluctuations and flow behavior occurring in at least one of the supply lines.

4. A method according to claim 3, wherein pressure fluctuations occur periodically; further comprising the step of converting the periodically occurring pressure fluctuations into signals by means of a pressure monitor.

5. A method according to claim 3, wherein changes in flow rate periodically; further comprising the step of converting the periodically occurring changes in the flow rate into signals by means of flow a sensor.

6. A method according to claim 1, wherein the percussion unit comprises a pressure line for the fluid entering the percussion unit and a return-flow line for returning the exiting fluid, and the generating step includes a step of detecting at least one of pressure fluctuations and flow behavior occurring in at least one of the pressure line and the return-flow line.

7. A method according to claim 1, wherein the signals are generated by a sound sensor detecting changes in the sound level occurring in dependence on the impacts by the percussion piston.

8. A method according to claim 1 wherein the signals are generated by means of a vibration sensor detecting vibrations triggered by the percussion piston movements.

9. A method according to claim 1, wherein the signals are generated by a motion sensor detecting displacement of a component of the percussion unit; said component moving in one movement direction as a result of the percussion piston strokes.

10. A method according to claim 1, wherein the signals are generated by one of a force sensor and a stress sensor detecting the stress exerted on a component of the percussion unit which changes periodically with the impacts carried out by the percussion piston.

11. A method according to claim 1, wherein the signals are generated by a temperature sensor detecting the temperature of a gas cushion which changes periodically with the percussion piston strokes.

12. A method according to claim 1, wherein the signals are generated by a pressure monitor detecting a gas cushion pressure changing periodically with the percussion piston strokes.

13. A method according to claim 1, further comprising the step of generating, once a predetermined total signal number is reached, at least one maintenance display at least showing that the percussion unit requires maintenance.

14. A method according to claim 13, further comprising the step of consecutively generating early warning displays depending on the current total number of stored signals; said displays showing that partial segments of a maintenance interval defined by a predetermined upper limit for the total signal number have been reached.

15. A method according to claim 1, further comprising the step of wirelessly transmitting the current total number of stored signals to an evaluation unit.

16. A method according to claim 1, further comprising the step of triggering a resetting of the current total number of stored signals by means of wireless transmission.

17. A method according to claim 1, further comprising the step of generating electric energy by a fluid which drives the percussion piston.

18. A method according to claim 17, wherein the electric energy is used for at least one of generating, adding, and storing the signals.

19. A method according to claim 1, further comprising the steps of generating electric energy for generating the signals by a generator operated by movements triggered by the percussion piston strokes and applying the electric energy to an electric storage unit.

20. A method according to claim 1, wherein the hydraulic percussion unit is a hydraulic hammer.

21. A device for determining the operating period and the operating condition of a hydraulic percussion unit having a percussion piston guided inside a housing and controlled by a control means to alternately perform an operating stroke in an impact direction and a return stroke in a return direction, the device comprising:

a sensor generating a number of signals during consecutive individual operating segments; the number of signals being proportional to the number of strokes performed by the percussion piston in one of the movement directions;

a counting element for continuously adding the number of generated signals;

a storage element for storing the current total number of the added signals; and a display element for displaying at least at times the current total number of added signals.

22. A device according to claim 21, wherein the sensor includes means for converting physical processes, occurring as a result of the percussion piston movements, into the signals.

23. A device according to claim 21, wherein the percussion unit further has a pressure line connecting the percussion unit to a source of pressure and the device further comprises a pressure monitor for detecting the pressure conditions in the pressure line.

24. A device according to claim 21, wherein said control means comprises a control plunger and wherein the percussion unit comprises a reversing line cooperating with said control plunger; further comprising a pressure monitor provided in the reversing line.

25. A device according to claim 21, wherein the percussion unit further has a gas cushion supporting the percussion piston on a side facing away from a tip thereof; further comprising a pressure monitor for detecting the pressure in the gas cushion.

26. A device according to claim 21, wherein the percussion unit further has a gas cushion supporting the percussion piston on a side facing away from a tip thereof; further comprising a temperature sensor for detecting the temperature in the gas cushion.

27. A device according to claim 21, further comprising an inductive motion sensor detecting the movements of the percussion piston relative to the motion sensor.

28. A device according to claim 21, further comprising an inductive vibration sensor detecting vibrations triggered by the percussion piston strokes.

29. A device according to claim 21, further comprising at least one strain gauge detecting the mechanical stresses exerted on the percussion unit by the percussion piston strokes.

30. A device according to claim 21, further comprising a sound level sensor detecting noises generated by the percussion piston strokes.

31. A device according to claim 21, further comprising an acceleration sensor detecting accelerations resulting from the percussion piston strokes.

32. A device according to claim 21, further comprising an electric generator for generating electric energy for generating the signals; and an electric storage unit connected to an ouptut of said generator; said generator including means being activated by motions of said percussion piston.

33. A device according to claim 32, wherein said means activated by motions of said percussion piston comprises a plunger coil.

34. A device according to claim 21, wherein the hydraulic percussion unit is a hydraulic hammer.

* * * * *

UNITED STATES PATENT AND TRADEMARK OFFICE

CERTIFICATE OF CORRECTION

PATENT NO. : 6,510,902 B1
DATED : January 28, 2003
INVENTOR(S) : Heinz-Jürgen Prokop et al.

It is certified that error appears in the above-identified patent and that said Letters Patent is hereby corrected as shown below:

Title page,
Item [73], change to read -- Atlas Copco Construction Tools GmbH, Essen, Germany --

Signed and Sealed this

Third Day of June, 2003

JAMES E. ROGAN
*Director of the United States Patent and Trademark Office*